US008854927B2

(12) United States Patent
Liao et al.

(10) Patent No.: US 8,854,927 B2
(45) Date of Patent: Oct. 7, 2014

(54) WATCH CAPABLE OF PLAYING SOUND

(71) Applicant: Hon Hai Precision Industry Co., Ltd., New Taipei (TW)

(72) Inventors: Kuang-Yao Liao, New Taipei (TW); Shiang-Hua Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/869,894

(22) Filed: Apr. 24, 2013

(65) Prior Publication Data

US 2014/0177403 A1 Jun. 26, 2014

(30) Foreign Application Priority Data

Dec. 21, 2012 (TW) ..... 101148901 A

(51) Int. Cl.
*G04C 21/00* (2006.01)
*G04G 13/02* (2006.01)

(52) U.S. Cl.
CPC ..... *G04G 13/02* (2013.01)
USPC ..... 368/250; 368/282

(58) Field of Classification Search
USPC ..... 368/243, 203–205, 250, 281–282, 107, 368/109
See application file for complete search history.

(56) References Cited

U.S. PATENT DOCUMENTS

| | | | | |
|---|---|---|---|---|
| 5,239,521 | A * | 8/1993 | Blonder | 368/10 |
| 5,737,692 | A * | 4/1998 | Lang | 455/66.1 |
| 7,618,260 | B2 * | 11/2009 | Daniel et al. | 439/37 |
| 2002/0181336 | A1 * | 12/2002 | Shields | 368/109 |

* cited by examiner

*Primary Examiner* — Sean Kayes
(74) *Attorney, Agent, or Firm* — Novak Druce Connolly Bove + Quigg LLP

(57) ABSTRACT

A watch capable of playing sound includes a main body and a sound playing body. The main body includes an interface unit, a signal amplification unit, a control unit, and a first electromagnetic coil unit. The control unit transmits audio signal to the signal amplification unit via the interface unit. The first electromagnetic coil unit generates inducted electromagnetic filed in response to the audio signal amplified by the signal amplification unit. The sound playing body includes a second electromagnetic coil unit and a loudspeaker. The second electromagnetic coil unit generates electric signal in response to the induced electromagnetic filed. The loudspeaker plays the audio signal in response to the electric signal.

2 Claims, 2 Drawing Sheets

WATCH CAPABLE OF PLAYING SOUND

CROSS-REFERENCES TO RELATED APPLICATIONS

Related subject matter is disclosed in U.S. patent application Ser. Nos. 13/869,898 and 13/869,030 with an and a title of WATCH HAVING MICROPHONE, and an and a title of WATCH HAVING MICROPHONE, which have the same assignees as the current application and were concurrently filed.

BACKGROUND

1. Technical Field

The present disclosure relates to watches and, particularly, to a watch capable of playing sound.

2. Description of the Related Art

Smart watches are employed for events reminder and time reminder besides displaying time and data. A loudspeaker is employed by the smart watch for playing sound to remind event or time. The loudspeaker is mounted in the watch which results in an additional circuit board being mounted in the watch, thus thickens the watch. Furthermore, the additional circuit board is powered by a battery of the watch which results in shortening service life of the battery of the watch.

Therefore, there is room for improvement within the art.

BRIEF DESCRIPTION OF THE DRAWINGS

The components in the drawings are not necessarily drawn to scale, the emphasis instead being placed upon clearly illustrating the principles of a lamp tube switch circuit. Moreover, in the drawings, like reference numerals designate corresponding parts throughout the several views.

DETAILED DESCRIPTION

Figure 1:
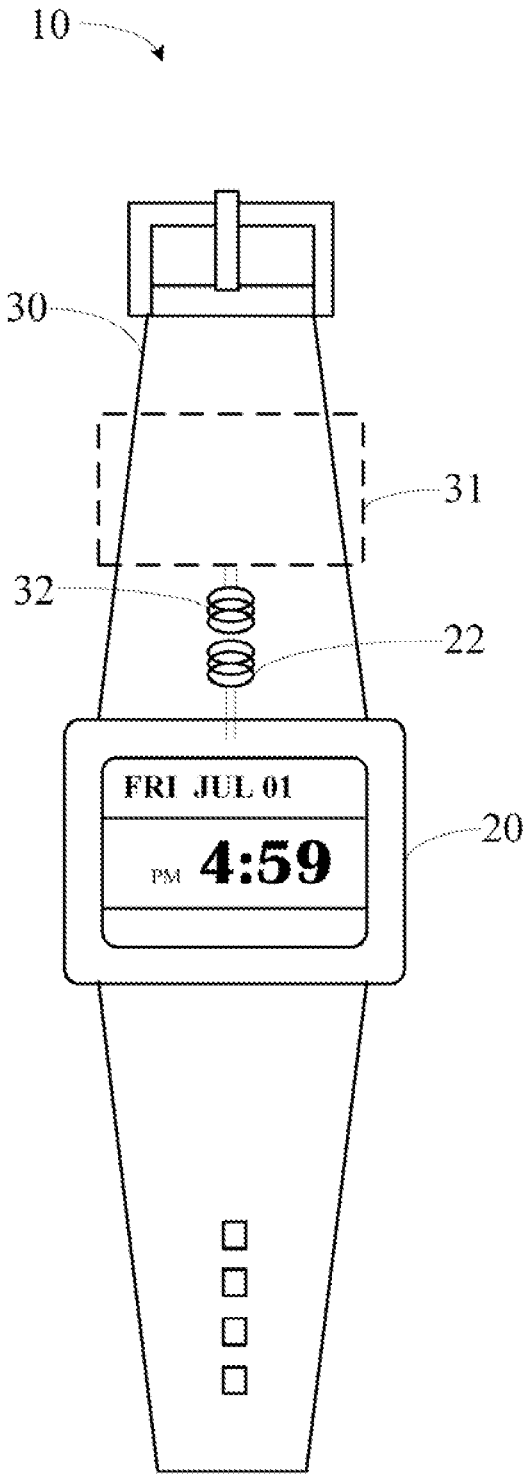
FIG. 1 is a schematic view of a watch capable of playing sound in accordance with an exemplary embodiment.

Referring to FIG. 1, a watch 10 includes a main body 20 and a sound playing body 30. In the embodiment, the watch 10 further includes a strap configured to tie the main body 20 to a wrist of a user, and the sound playing body 30 is mounted on the strap. In an alternative embodiment, the sound playing body 30 is mounted on the main body 20. The main body 20 includes a display screen for displaying time and other types of data.

Figure 2:
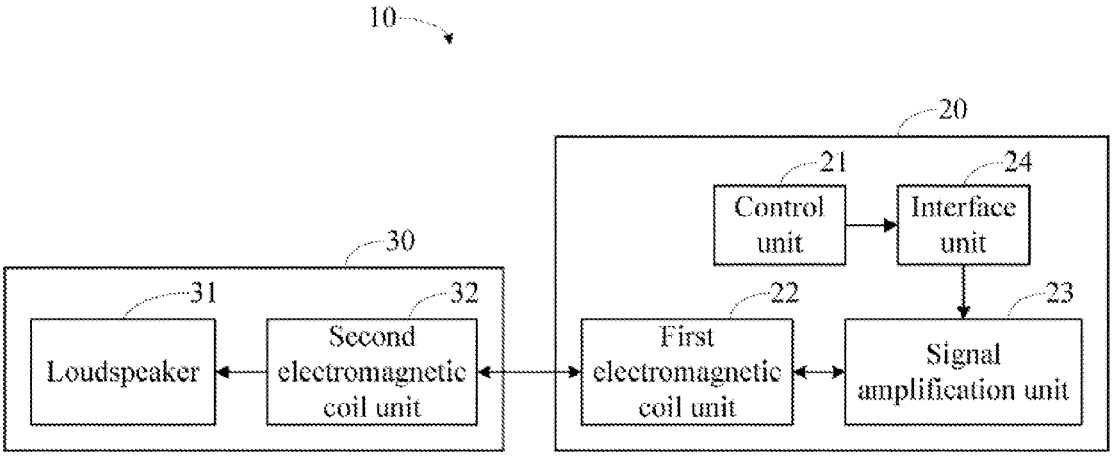
FIG. 2 is a diagram of the watch of FIG. 1 in accordance with an exemplary embodiment.

Referring to FIG. 2, the main body 20 includes a control unit 21, a first electromagnetic coil unit 22, a signal amplification unit 23, and an interface unit 24. The sound playing body 30 includes a loudspeaker 31 and a second electromagnetic coil unit 32. The second electromagnetic coil unit 32 is connected to the loudspeaker 31. The first electromagnetic coil unit 22 is mounted on the main body 20 coupling the second electromagnetic coil unit 32. In the embodiment, the first electromagnetic coil unit 22 is mounted on a frame of the main body 20.

The control unit 21 is connected to the signal amplification unit 23 via the interface unit 24, and the first electromagnetic coil unit 22 is connected to the signal amplification unit 23. The control unit 21 transmits audio signal to the signal amplification unit 23 via the interface unit 24. The signal amplification unit 23 amplifies the audio signal transmitted by the control unit 21.

The first electromagnetic coil unit 22 generates an inducted electromagnetic field in response to the audio signal amplified by the signal amplification unit 23. The generation of the electromagnetic field results in the generation of electric signal in the second electromagnetic coil unit 32. The loudspeaker 31 receives the electric signal from the second electromagnetic coil unit 32, and plays the audio signal in response to the received electric signal. Thereby, the loudspeaker 31 can play sound without additional power supply.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A watch capable of playing sound comprising:

a main body comprising:

an interface unit;

a signal amplification unit;

a control unit configured to transmit an audio signal to the signal amplification unit via the interface unit; and a first electromagnetic coil unit connected to the signal amplification unit, configured to generate an inducted electromagnetic field in response to the audio signal amplified by the signal amplification unit;

a strap configured to tie the main body to a wrist of a user; and a sound playing body mounted on the strap, the sound playing body comprising: a second electromagnetic coil and a loudspeaker;

the second electromagnetic coil unit coupled with the first electromagnetic coil unit, configured to generate an electric signal in response to the generation of the induced electromagnetic field; and the loudspeaker connected to the second electromagnetic coil unit, configured to play the audio signal in response to the electric signal generated by the second electromagnetic coil unit.

2. The watch capable of playing sound as recited in claim 1, wherein the first electromagnetic coil unit is mounted on a frame of the main body.

* * * * *